US005944500A

United States Patent [19]

Iizuka

[11] Patent Number: 5,944,500

[45] Date of Patent: Aug. 31, 1999

[54] SCROLL-TYPE FLUID DISPLACEMENT APPARATUS HAVING A STRENGTHENED INNER TERMINAL END PORTION OF THE SPIRAL ELEMENT

[75] Inventor: Jiro Iizuka, Takasaki, Japan

[73] Assignee: Sanden Corporation, Gunma, Japan

[21] Appl. No.: 08/877,896

[22] Filed: Jun. 18, 1997

[30] Foreign Application Priority Data

Jun. 20, 1996 [JP] Japan ..... P08-159462

[51] Int. Cl.[6] ..... F01C 1/04

[52] U.S. Cl. ..... 418/55.2

[58] Field of Search ..... 418/55.2

[56] References Cited

U.S. PATENT DOCUMENTS

| | | | |
|---|---|---|---|
| 2,324,168 | 4/1943 | Montelius | 418/55.2 |
| 3,600,114 | 8/1971 | Dvorak et al. | 418/55.2 |
| 4,457,676 | 7/1984 | Hiraga | 418/55.5 |
| 4,547,137 | 10/1985 | Terauchi et al. | 418/55.2 |
| 4,594,061 | 6/1986 | Terauchi | 418/55.2 |
| 5,037,279 | 8/1991 | Suefuji et al. | 418/55.2 |
| 5,059,102 | 10/1991 | Tokumitsu et al. | 418/55.2 |
| 5,370,512 | 12/1994 | Fujitani et al. | 418/55.2 |

FOREIGN PATENT DOCUMENTS

| | | | |
|---|---|---|---|
| 0106288 | 10/1983 | European Pat. Off. . | |
| 0392975 | 3/1990 | European Pat. Off. . | |
| 0761971 | 3/1997 | European Pat. Off. . | |
| 58-013184 | 1/1983 | Japan . | |
| 58-172405 | 10/1983 | Japan . | |
| 59-079090 | 5/1984 | Japan . | |
| 1-130083 | 5/1989 | Japan . | |
| 3-225002 | 10/1991 | Japan . | |
| 4-279785 | 10/1992 | Japan . | |
| 4-350378 | 12/1992 | Japan . | |
| 4350378 | 12/1992 | Japan | 418/55.2 |
| 6101665 | 4/1994 | Japan | 418/55.2 |
| 2161218 | 1/1986 | United Kingdom . | |

*Primary Examiner*—John J. Vrablik
*Attorney, Agent, or Firm*—Baker & Botts, LLP

[57] ABSTRACT

A scroll-type fluid displacement apparatus includes a pair of scrolls having a circular end plate and a spiral wrap extending from an axial end surface of the circular end plate. A pair of scrolls is maintained at an angular and radial offset to make a plurality of line contacts between the spiral curved surfaces, which define fluid pockets. A driving mechanism is operatively connected to one of the scrolls to effect relative orbital motion with respect to the other scrolls to thereby change the volume of the fluid pockets. The spiral element of each scroll member has a stepped cross-section. As a result, the mechanical strength of the spiral elements of the scroll member of the fluid displacement apparatus is increased and the fluid displacement apparatus has increased durability and efficiency.

10 Claims, 9 Drawing Sheets

SCROLL-TYPE FLUID DISPLACEMENT APPARATUS HAVING A STRENGTHENED INNER TERMINAL END PORTION OF THE SPIRAL ELEMENT

BACKGROUND OF THE INVENTION

1. Field of the Invention

The present invention relates to a scroll-type fluid displacement apparatus and, more particularly, to a scroll-type fluid compressor having improved spiral elements on its scroll members.

2. Description of the Related Art

Scroll-type fluid displacement apparatuses are known in the prior art. For example, U.S. Pat. No. 4,678,415, issued to Hirano et al., discloses a basic construction of a scroll-type fluid displacement apparatus including two scroll members, each having an end plate and a spiroidal or involute spiral element extending from the end plates. The scroll members are maintained angularly and radially offset so that both spiral elements interfit to form a plurality of line contacts between their spiral curved surfaces to thereby seal off and define at least one pair of fluid pockets. The relative orbital motion of the two scroll members shift the line contact along the spiral curved surfaces and, as a result, change the volume in the fluid pockets. The volume of the fluid pockets increases or decreases depending on the direction of orbital motion. Thus, a scroll-type apparatus is applicable to compress, expand, or pump fluids.

A scroll-type fluid displacement apparatus is suitable for use as a refrigerant compressor. When used as a compressor, it is desirable for the scroll members to have sufficient mechanical strength to compress fluid under high pressure. In scroll members known in the prior art, the end plates and associated spiral elements are integrally formed. In those scroll-type fluid compressors, the interfitting spiral elements, normally constructed of lightweight alloys, such as an aluminum alloy, are subject to several temperature changes which are caused when fluid moves to the center of the compressor, increasing its pressure and decreasing its volumne. The hottest temperature exists in the center of the compressor, because that pocket has the smallest volume and highest pressure. This causes thermal expansion at the center of the spiral elements to be greater than at any other portion. However, the base or end portion of the spiral element, i.e., the portion which joins the end plate, particularly the inner end portion or edge, is subjected to greater stress than the outer radial portion. Accordingly, due to fatigue and deterioration caused by this stress, the strength and rigidity of the inner portion of the spiral element is substantially reduced over time. As a result, the center of the spiral element is subject to damage and failure.

Further, the scroll-type compressor is particularly suitable for use in an automobile air conditioner where compact size is desirable. However, if the height of the spiral element is increased to enlarge the displacement volume of the compressor without expanding its overall diameter, the stress developed inside the scroll is increased. Accordingly, the above described deterioration of the radial inner portion of each spiral element is hastened.

One solution to these problems is disclosed in U.S. Pat. No. 4,547,137 (Japanese Patent No. HEI-3-72839). The outer and inner side wall surfaces of both wraps define involute curves. The involute outer side wall surface starts from an arbitrary involute angle, and the involute inner side wall surface starts from an involute angle of 180 degrees from the arbitrary involute angle. The starting points of the involute side wall surfaces are interconnected by an inner end surface comprised of at least two arcuate surfaces to form a thicker inner end portion of the wrap. The inner and outer end portions of the spiral wraps, i.e., where the inner and outer involute curves start, are subjected to significant stress since those portions are in contact with the opposite spiral element during sealing and are subjected to high fluid pressure during operation. solution is disclosed in U.S. Pat. No. 4,594,061 (Japanese Utility Model Patent No. HEI-1-26315). This patent discloses that a base or proximal portion of an inner end of each spiral wrap is provided with an extension, such as a rib portion. The rib portion increases the cross-sectional area of the base or proximal portion of the spiral wrap such that it is larger than the cross-sectional area of the upper or distal portion of the wrap. Therefore, the strength of the base portion of the inner end of the wrap is greatly increased and destruction of the wrap due to high stress and high temperature is significantly reduced. However, radial sealing of the fluid pockets must be maintained in a scroll-type compressor in order to achieve efficient operation, but in this arrangement, complete engagement of the spiral wraps cannot be realized. Consequently, the compression efficiency is lowered.

These and other problems with prior art fluid development apparatuses are sought to be addressed by the following preferred embodiments.

SUMMARY OF THE INVENTION

It is an object of the present invention to provide a fluid displacement apparatus which has excellent durability and efficiency.

It is another object of the present invention to provide a fluid displacement apparatus in which the mechanical strength of the spiral elements of the scroll members is increased.

According to the present invention, a scroll-type fluid displacement apparatus includes a pair of scrolls each having a circular end plate and a spiral wrap extending from an axial end surface of the circular end plate. The pair of scrolls is maintained at an angular and radial offset to form a plurality of line contacts between the spiral curved surfaces, which define fluid pockets. A driving mechanism is operatively connected to one of the scrolls to effect relative orbital motion with respect to the other scrolls to thereby change the volume of the fluid pockets.

An inner terminal end of the spiral element of each scroll member comprises an axial cross-sectional area that increases proportionally along the spiral element. The inner terminal end of the spiral wraps of each scroll member is provided with an extension at the proximal portion.

Further objects, features and other aspects of this invention will be understood from the following detailed description of the preferred embodiments of this invention with reference to the annexed drawings.

DETAILED DESCRIPTION OF THE PREFERRED EMBODIMENTS

Figure 1:
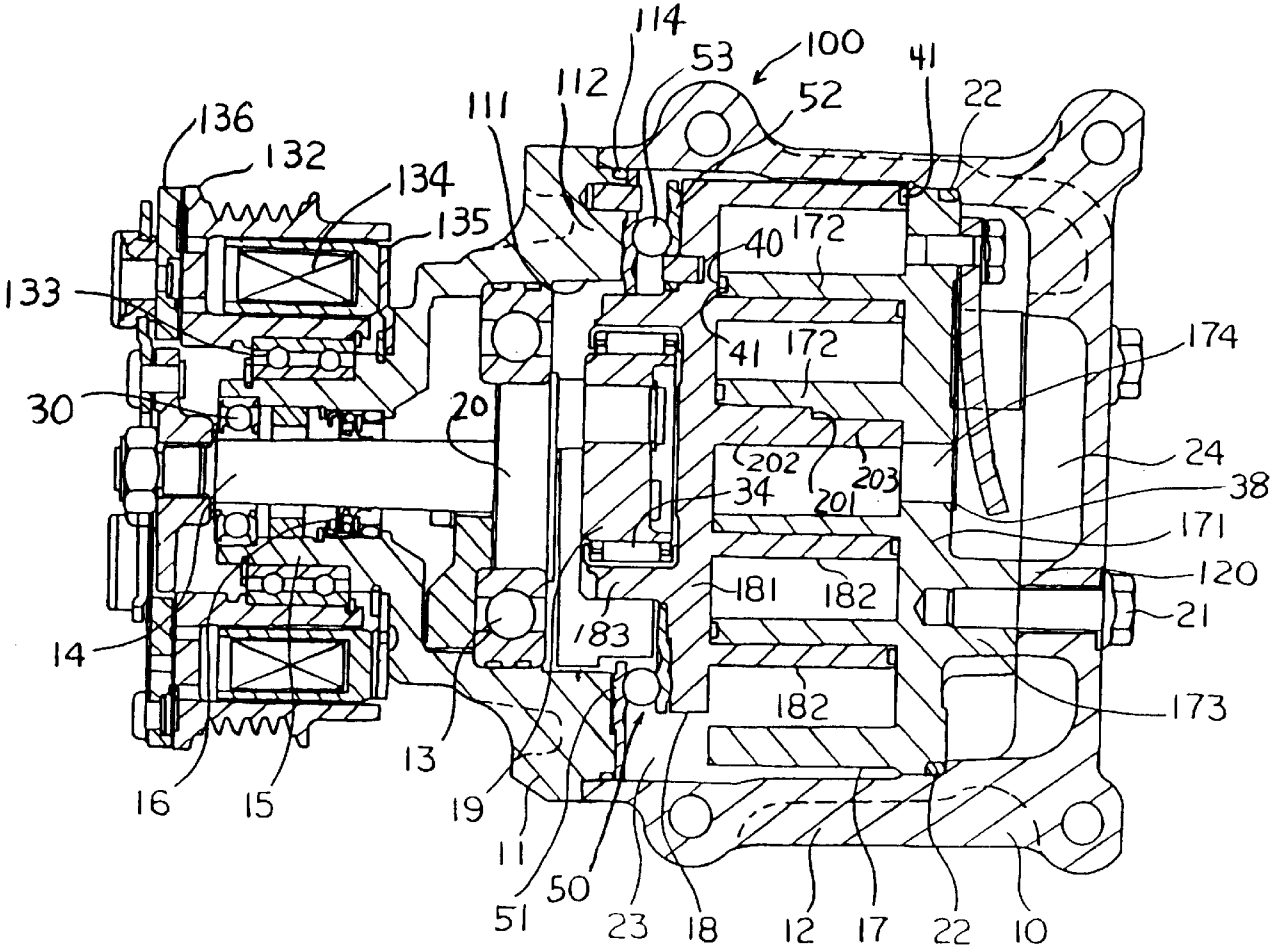
FIG. 1 is a vertical longitudinal cross-sectional view of a scroll-type refrigerant compressor in accordance with a first embodiment of the present invention.

Referring to FIG. 1, a fluid displacement apparatus in accordance with the present invention is shown in the form of a scroll-type refrigerant compressor 100. Compressor unit 100 includes compressor housing 10 having a front end plate 11 mounted on cup-shaped casing 12.

An opening 111 is formed in the center of front end plate 11 for penetration of drive shaft 14. An annular projection 112 is formed in the rear end surface of front end plate 11. Annular projection 112 faces cup-shaped casing 12 and is concentric with opening 111. An outer peripheral surface of annular projection 112 extends into an inner wall of the opening of cup-shaped casing 12 so that the opening of cup-shaped casing 12 is covered by front end plate 11. An O-ring 114 is placed between the outer peripheral surface of annular projection 112 and the inner wall of the opening of cup-shaped casing 12 to seal the mating surfaces of front end plate 11 and cup-shaped casing 12.

An annular sleeve 15 projects from the front end surface of front end plate 11 to surround drive shaft 14. Annular sleeve 15 defines a shaft seal cavity. In the embodiment shown in FIG. 1, sleeve 15 is formed integrally with front end plate 11. Alternatively, sleeve 15 may be formed separately from front end plate 11.

Drive shaft 14 is rotatably supported by sleeve 15 through bearing 30 which is located within the front end of the sleeve 15. Drive shaft 14 has a disk 20 at its inner end. Disk 20 is rotatably supported by front end plate 11 through bearing 13 located within opening 111 of front end plate 11. A shaft seal assembly 16 is coupled to drive shaft 14 within the shaft seal cavity of sleeve 15.

A pulley 132 is rotatably supported by bearing 133, which is carried on the outer surface of sleeve 15. An electromagnetic coil 134 is fixed about the outer surface of sleeve 15 by a support plate 135, and is disposed within an annular cavity of pulley 132. An armature plate 136 is elastically supported on the outer end of drive shaft 14. Pulley 132, magnetic coil 134, and armature plate 136 form a magnetic clutch. In operation, drive shaft 14 is driven by an external drive power source, for example, the engine of an automobile, through a rotation transmitting device, such as a magnetic clutch.

A number of elements are located within the inner chamber of cup-shaped casing 12 including a fixed scroll 17, an orbiting scroll 18, a driving mechanism for orbiting scroll 18 and a rotation preventing/thrust bearing device 50 for orbiting scroll 18. The inner chamber of cup-shaped casing 12 is formed between the inner wall of cup shaped casing 12 and the rear end surface of front end plate 11.

Fixed scroll 17 includes a circular end plate 171, a wrap or spiral element 172 affixed to or extending from one side surface of circular end plate 171 and internally threaded bosses 173 axially projecting from the other end surface of circular end plate 171. An axial end surface of each boss 173 is seated on the inner surface of bottom plate portion 120 of cup shaped casing 12 and fixed by screws 21 screwed into bosses 173. Thus, fixed scroll 17 is fixed within the inner chamber of cup shaped casing 12. Circular end plate 171 of fixed scroll 17 partitions the inner chamber of cup shaped casing 12 into a front chamber 23 and rear chamber 24. A seal ring 22 is disposed within a circumference groove of circular end plate 171 to form a seal between the inner wall of cup shaped casing 12 and the outer surface of circular end plate 171. Spiral element 172 of fixed scroll 17 is located within front chamber 23.

Cup-shaped casing 12 is provided with a fluid inlet port and fluid outlet port (not shown), which are connected to rear and front chambers 23 and 24, respectively. A discharge port 174 is formed through circular end plate 171 near the center of spiral element 172. A reed valve 38 closes discharge port 174.

Orbiting scroll 18, which is located in front chamber 23, includes a circular end plate 181 and a wrap or spiral element 182 affixed to or extending from one side surface of circular end plate 181. Spiral elements 172 and 182 interfit at an angular offset of 180 degrees and a predetermined radial offset. Spiral elements 172 and 182 define at least one pair of sealed off fluid pockets between their interfitting surfaces. Orbiting scroll 18 is rotatably supported by a bushing 19 through a bearing 34 placed between the outer peripheral surface of bushing 19 and an inner surface of annular boss 183 axially projecting from the end surface of circular end plate 181 of orbiting scroll 18. Bushing 19 is connected to an inner end of disk 20 at a point radially offset or eccentric with respect to drive shaft 14.

Rotation preventing/thrust bearing device 50 is disposed between the inner end surface of front end plate 11 and the end surface of circular end plate 182. Rotation preventing/thrust bearing device 50 includes a fixed ring 51 attached to the inner end surface of front end plate 11, an orbiting ring 52 attached to the end surface of circular end plate 181, and a plurality of bearing elements 53, such as balls, placed between the pockets formed by rings 51 and 52. The axial thrust load from orbiting scroll 18 also is supported on front end plate 11 through balls 53.

Spiral elements 172 and 182 include grooves 41 on the axial end surface thereof. Seal element 40 is disposed in the grooves 41 to provide a seal between the end surfaces of circular end plates 171 and 181 and the axial end surface of each seal element 40.

Figure 2:
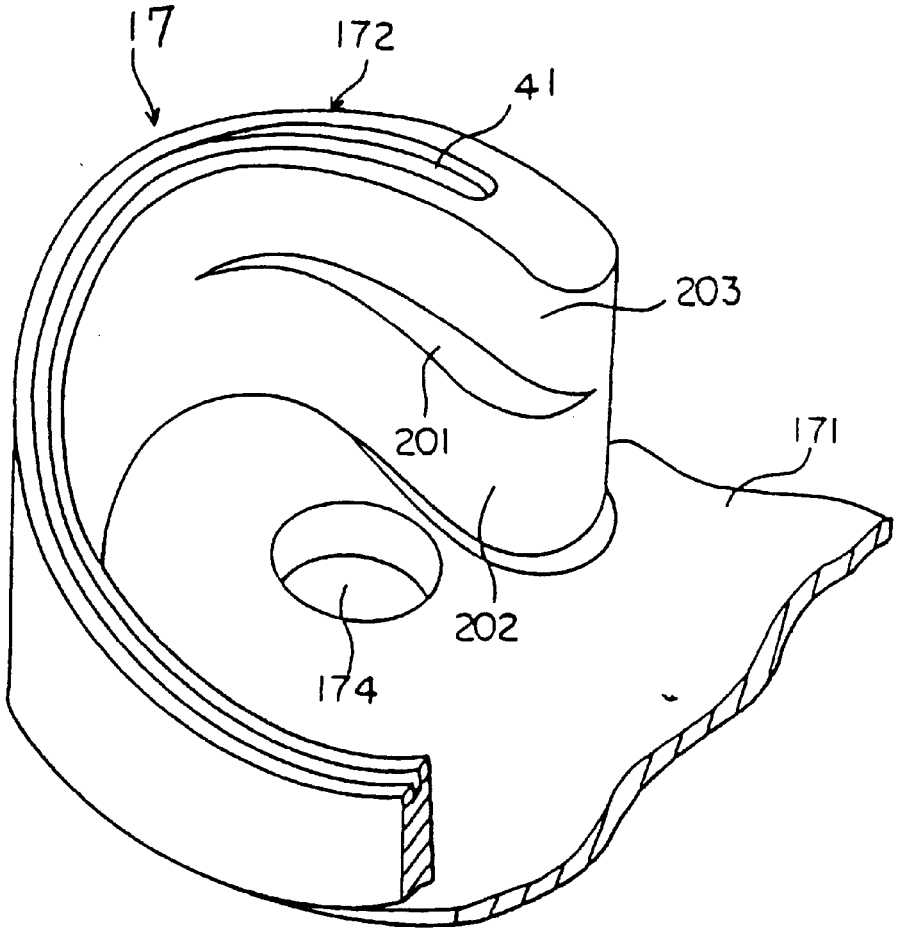
FIG. 2 is an enlarged partial view of a fixed scroll member of a scroll-type refrigerant compressor in accordance with the first embodiment of the present invention.

With reference to FIG. 2, the configuration of the scroll members, particularly the spiral wrap elements, is depicted. The two spiral wraps 172 and 182 are essentially mirror images of each other. Spiral wrap 172 includes a step-like portion 201 formed at the axial center thereof. Step-like portion 201 substantially divides spiral wrap 172 into a root portion 202 and a tip portion 203. Step-like portion 201 is made so that the cross sectional area is reduced stepwise from root portion 202 to tip portion 203.

Figure 3:
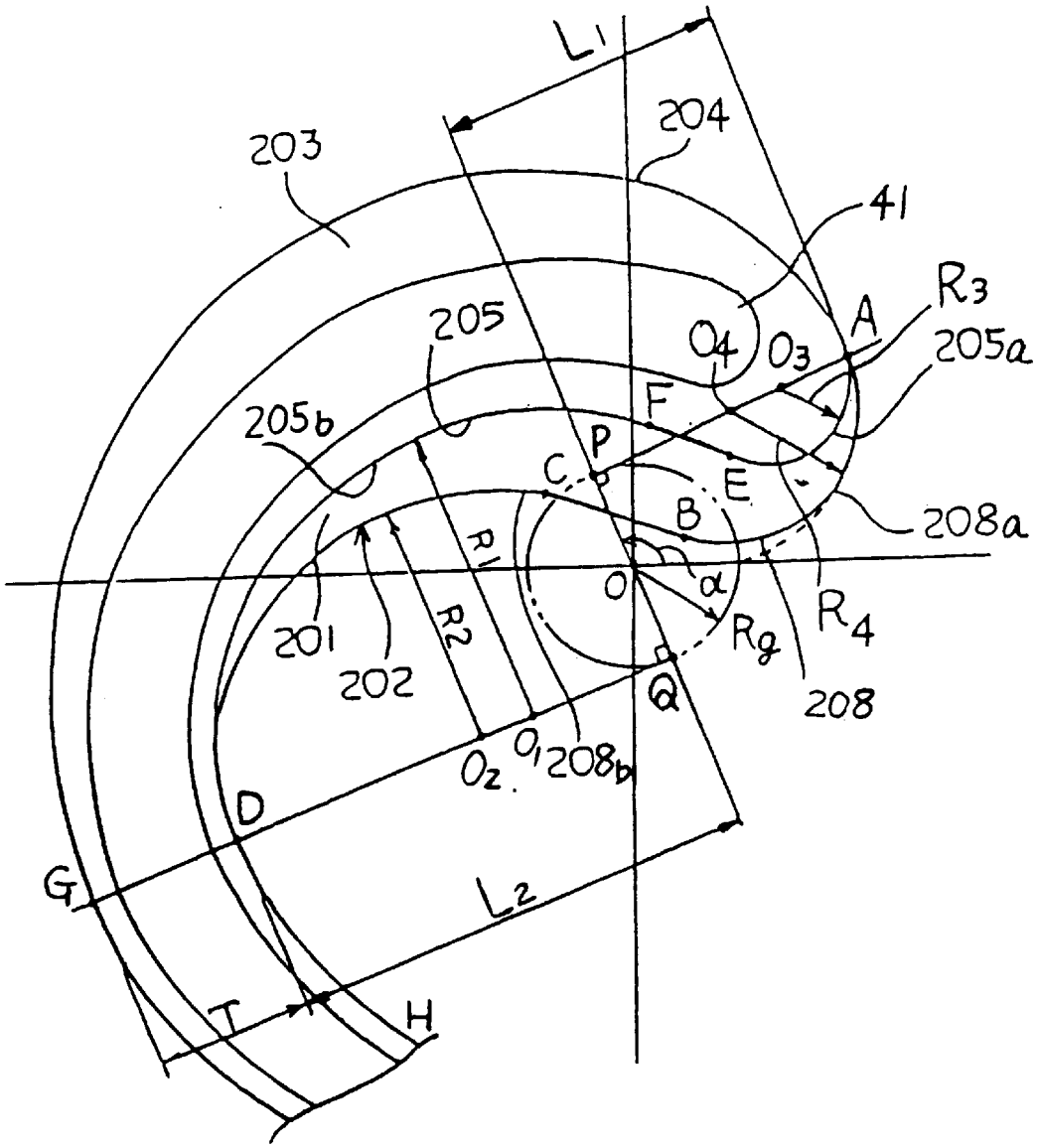
FIG. 3 is a schematic front elevational view illustrating the configuration of scroll members of a scroll-type refrigerant compressor in accordance with the first embodiment of the present invention.

With reference to FIG. 3, a profile of tip portion 203 of spiral wrap 172 is illustrated. An outer side wall 204 of spiral wrap 172 is generally formed by an involute curve. The involute curve which forms outer side wall 204 of spiral wrap 172 starts from point A. Point A is located at the intersection of the involute curve and the line tangent to the involute generating circle through point P.

A first inner side wall 205 starts form point D. Point D is located at the intersection of the involute curve and the line tangent to the involute generating circle through point Q. Angle $\alpha$ is an arbitrary involute angle. P is a point located on the involute generating circle corresponding to involute angle $\alpha$ and Q is a point located on the involute generating circle corresponding to involute angle $\alpha$+180 degrees.

An arbitrary point $O_3$ is set on the tangent line P-A, and a first connection arc 205*a* (A-E) of radius $R_3$ is about point $O_3$. An arbitrary point $O_1$ is set on the tangent line Q-D, and a first curve 205*b* (F-D) of radius $R_1$ is about point $O_1$. Also, point A is a boundary point between outer side wall 204 and first connection arc 205*a*, where both curves share an identical tangential line, and points E and F, which are located at the ends of linear line E-F, are boundary points between first curve 205*b* and first connection arc 205*a*. Further, point D is a boundary point existing between first curve 205*b* and an involute curve D-H, where both curves share an identical tangential line. Point H is in an area sufficiently outside of inner side wall 205.

A profile of root portion 202 of spiral wrap 172 is also illustrated in FIG. 3. The two spiral wraps 172 and 182 are essentially mirror images of each other. A second inner side wall 208 starts from point D. An arbitrary point $O_4$ is set on the tangent line P-A, and a second connection arc 208*a* (A-B) of radius $R_4$ is about an arbitrary point $O_2$. Arbitrary point $O_2$ is set on the tangent line Q-D, and a second curve 208*b* (C-D) of radius $R_2$ is about point $O_2$. Moreover, point A is a boundary point between outer side wall 204 and second connection arc 208*a*, where both curves share an identical tangential line, and points B and C, which are located at the ends of linear line B-C, are boundary points between the second curve 208*b* and the second connection arc 208*a*.

Thus, straight line B-C is parallel to straight line E-F, radius $R_1$ is greater than radius of $R_2$, and radius $R_4$ is greater than radius $R_3$. When radius $R_0$ is the orbital radius of the orbiting scroll member, radii $R_1$ and $R_2$ of this configuration are given by the following equations:

$$R_1=R_4+R_0 \quad (1)$$

$$R_2=R_3+R_0 \quad (2)$$

Further, T (line G-D) is the thickness of spiral wrap 172 at point D, $L_1$ is the distance between points P and A, and $L_2$ is the distance between points Q and D. When radius $R_g$ is the radius of the involute generating circle, distance $L_1$ is given by the following equation:

$$L_1=L_2+\pi R_g \quad (3)$$

Thus, an angular parameter $\alpha$ represents an angle contained between a straight line passing through an origin O and the negative quadrant of the X-axis. The two intersection points of the straight line passing through the origin of the involute base circle and defined at angle $\alpha$ with the base circle are found on the extension of the straight lines D-$O_1$ and A-$O_3$ at points Q and P, respectively. In addition, lines D-$O_1$ and A-$O_3$ are parallel to each other.

Therefore, first and second inner side walls 205 and 208, which consist of four arcs and two straight lines, and the outer side wall 204, which consists of a involute curve, collectively form the profile of spiral wraps 172 and 182.

Figure 4:
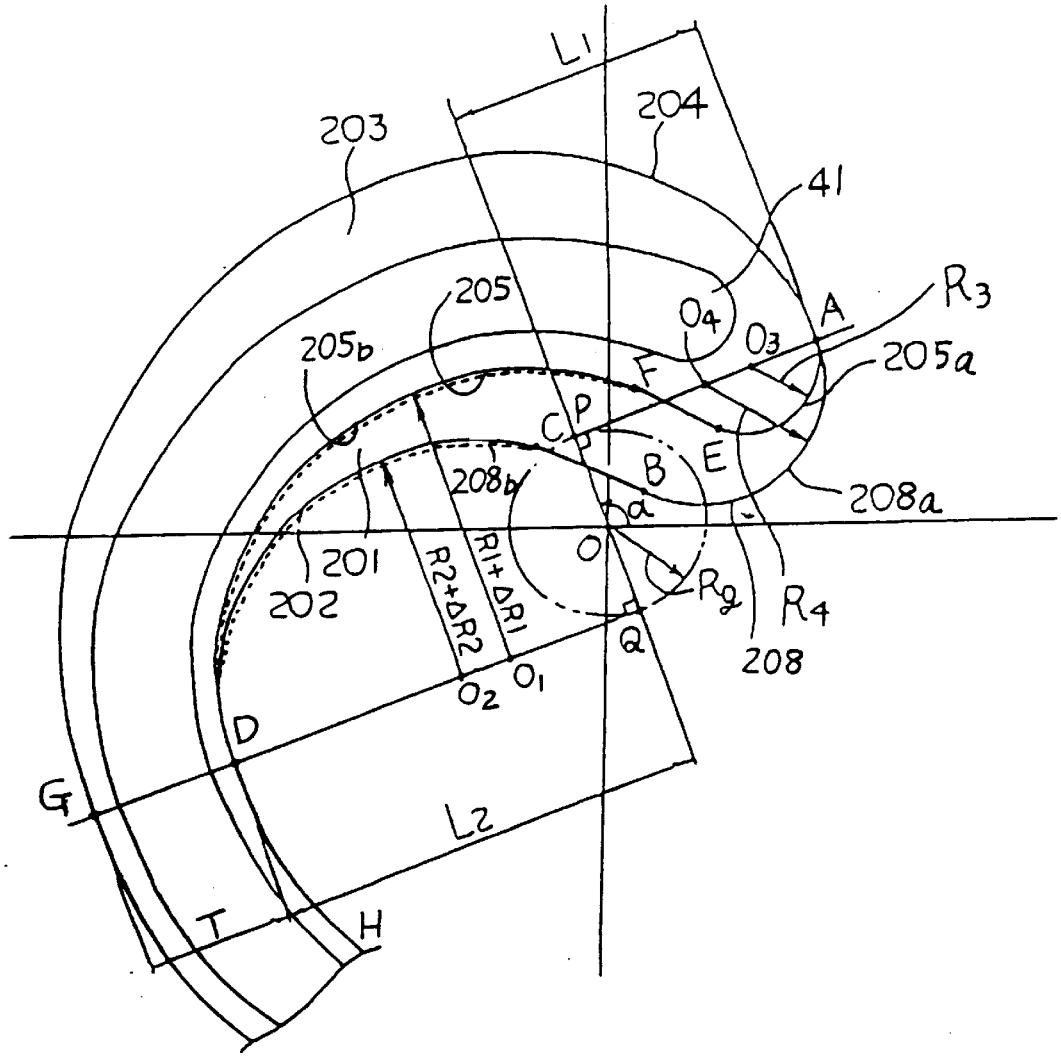
FIG. 4 is a schematic front view illustrating modifications to the profile of the spiral element shown in FIG. 3.

As a result of possible misalignment of the angular relationship between the spiral wraps which may occur during assembly of the compressor, or dimensional errors in the spiral wraps which may occur during manufacturing, the enlarged inner end portion of both spiral wraps may interfere with one another. Referring to FIG. 4, to avoid this possibility, radius $R_1$ of first curve 205*b* can be slightly increased by $\Delta R_1$ and $R_2$ of second curve 208*b* can be slightly increased by $\Delta R_2$. The previous configuration illustrated in FIG. 3 is shown by phantom lines for comparison.

Figure 5:
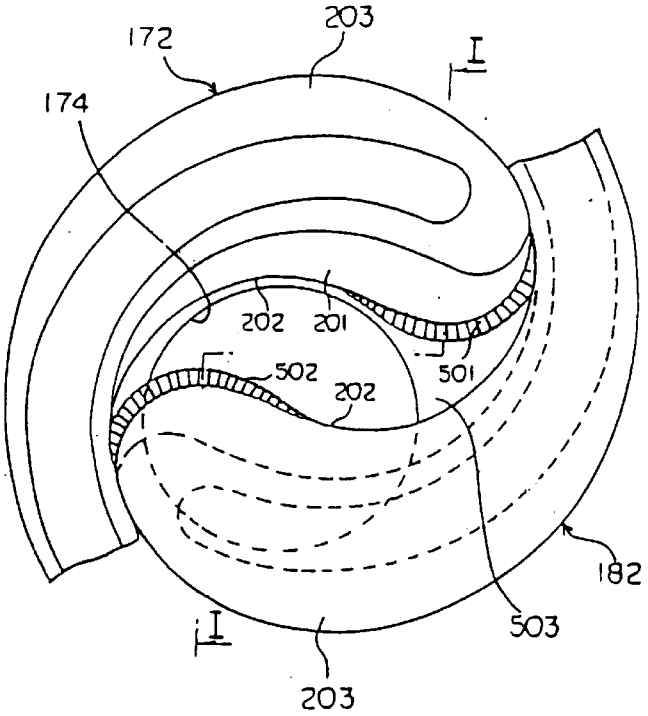
FIG. 5 is an enlarged schematic view illustrating the relative movement of the interfitting spiral elements of the scroll member of the scroll-type refrigerant compressor in accordance with the first embodiment of the present invention.
Figure 6:
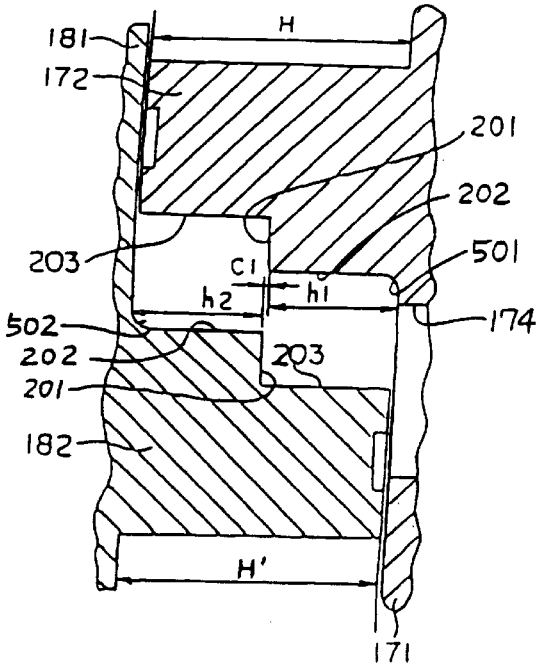
FIG. 6 is an enlarged cross-sectional view of the interfitting spiral elements taken along line VI—VI of FIG. 5.

FIGS. 5 and 6 illustrate the relative movement of the interfitting spiral wraps with fillets 501 and 502. Fillets 501 and 502 are formed at the place where end plates 171 and 181 join the root or proximal portion 202 of spiral wraps 172 and 182, respectively. Fillets 501 and 502 have a predetermined radius of curvature in the cross-section of spiral wraps 172 and 182. Thus, fillets 501 and 502 can be formed by simultaneously casting them during the forming of the scroll or may be formed by an end mill in a subsequent operation. Thus, the outer surface of the spiral wraps is in contact with the inner surface of the facing wraps to maintain a sealed off fluid pocket 503.

Referring to FIG. 6, spiral wrap 172 has an actual height H which defines the height of the compressor and height $h_1$ defined between the inner surface of end plate 171 and step 201 of spiral wrap 172. Similarly, spiral wrap 182 has an actual height H' and height $h_2$ defined between the inner surface of end plate 181 and step 201. Clearance $C_1$ is created between the surfaces of step 201 of spiral wraps 172 and 182 according to the following relationship:

$$C_1 \geqq H-(h_1+h_2) \quad (4)$$

$$C_1 \geqq H'-(h_1+h_2) \quad (5)$$

Further, the value of heights $h_1$ and $h_2$ is designed according to characteristics of the spiral wraps, such as the coefficient of expansion or rigidity.

In the above embodiment, fluid from an external fluid circuit is introduced into fluid pockets in the compressor unit through an inlet port (not shown). The fluid pockets comprise open spaces formed between spiral elements 172 and 182. As orbiting scroll 18 orbits, the fluid in the fluid pockets moves to the center of the spiral elements and is compressed. The line contact formed between spiral wraps 172 and 182, used to define the fluid pockets, shifts inward toward the center of the interfitting spiral wraps along the involute curve. Thereafter, the line of contact becomes a straight line along the common tangent lines E-F and C-B. At this time, the volume of the central high pressure space 503 becomes approximately zero and the compressed fluid from the fluid pockets is discharged into a rear chamber 24 through discharge hole 174. The compressed fluid is then discharged to the external fluid circuit through an outlet port (not shown).

Accordingly, the thickness of the inner end portion of each of the spiral wraps is increased so that the strength of the spiral wraps is improved, while simultaneously the volume of re-expansion of the fluid is reduced. This improvement can prevent a loss of power and a reduction of compression efficiency.

Figure 7:
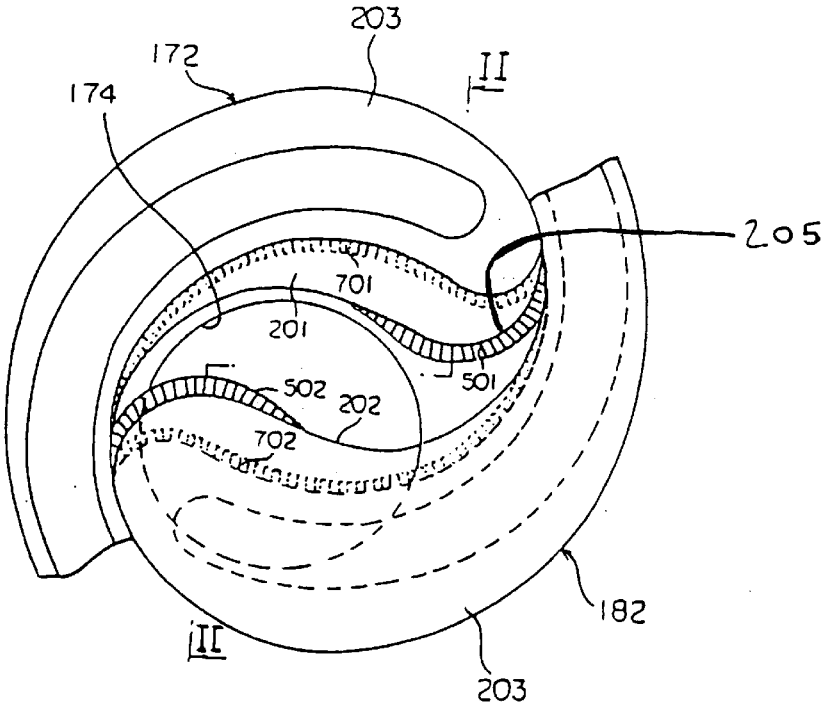
FIG. 7 is an enlarged schematic view illustrating the relative movement of the interfitting spiral elements of the scroll member of the scroll-type refrigerant compressor in accordance with a second embodiment of the present invention.
Figure 8:
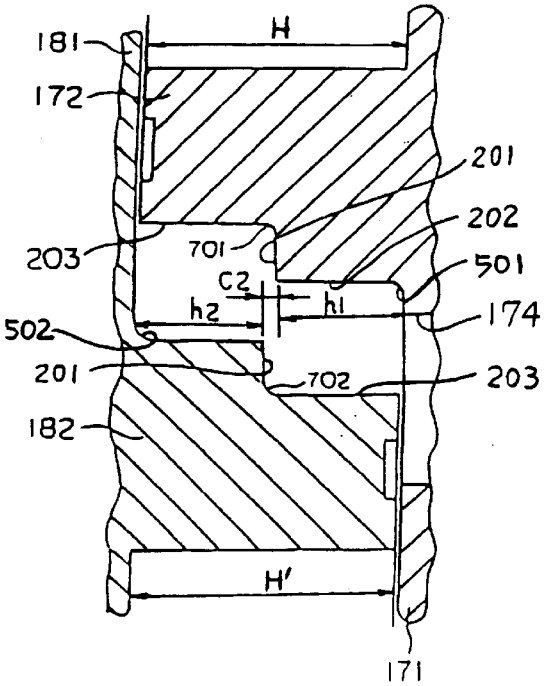
FIG. 8 is an enlarged sectional view of the intermitting spiral elements taken along line VIII—VIII of FIG. 7.

In FIGS. 7–13, the same numerals and letters are used to denote the corresponding elements depicted in FIGS. 1–6 so the description is primarily reserved for differences between the embodiments. FIGS. 7 and 8 illustrate a second embodiment of the present invention which is directed to a modified configuration of spiral wraps 172 and 182 of scroll members 17 and 18. These spiral wraps are similar to spiral wraps 172 and 182 described above. However, some differences do exist.

Fillets 701 and 702 are formed where step 201 joins the tip portion 203 of spiral wraps 172 and 182, respectively, so as to be entirely along the first inner side wall 205 as depicted in FIG. 7. Fillets 701 and 702 also have a certain radius of curvature in the cross section of spiral wraps 172 and 182. In addition to equations (4) and (5) of the first embodiment, clearance $C_2$ created between the surfaces of step 201 of spiral wraps 172 and 182 is designed to be greater than the curvature of both fillets 501 and 701 as shown in FIG. 8.

Figure 9:
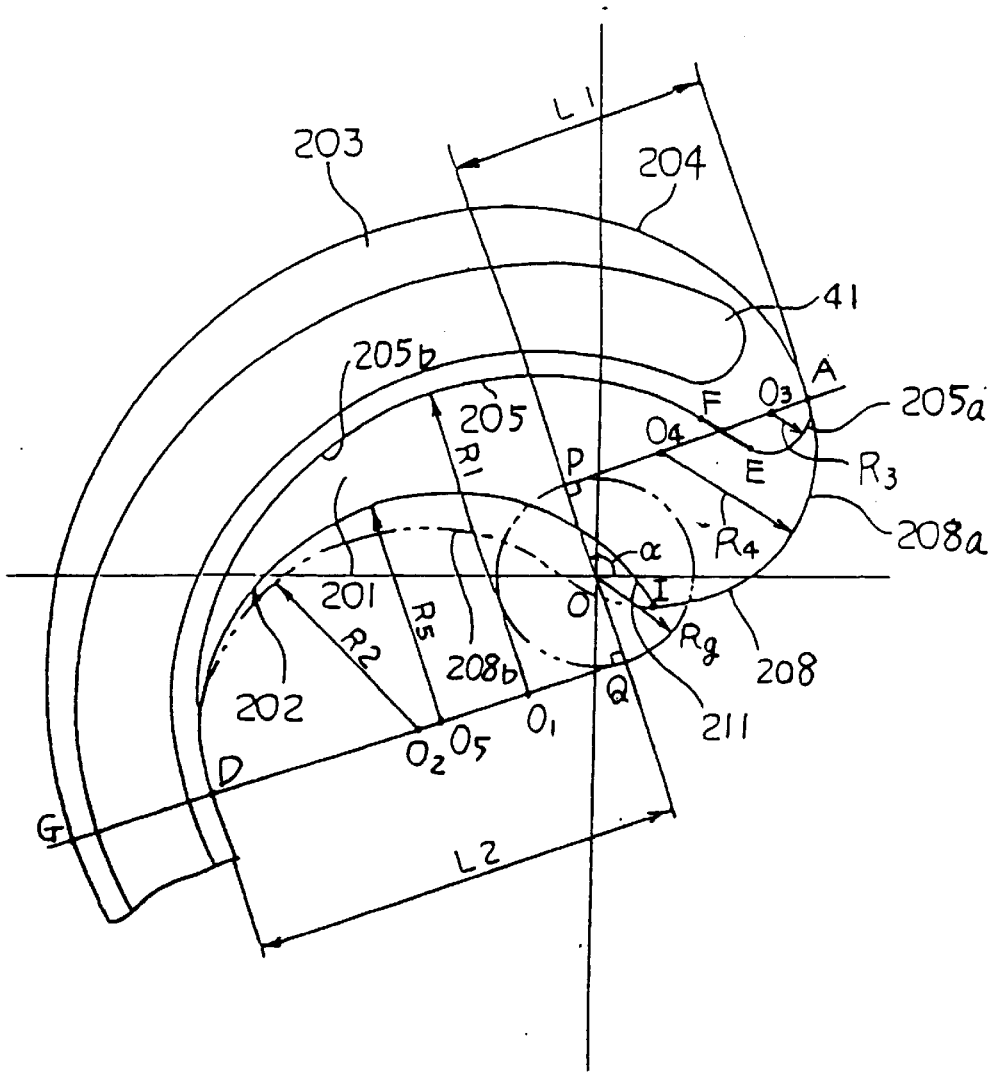
FIG. 9 is a schematic front operational view illustrating the configuration of the scroll members of the scroll-type refrigerant compressor in accordance with a third embodiment of the present invention.
Figure 10:
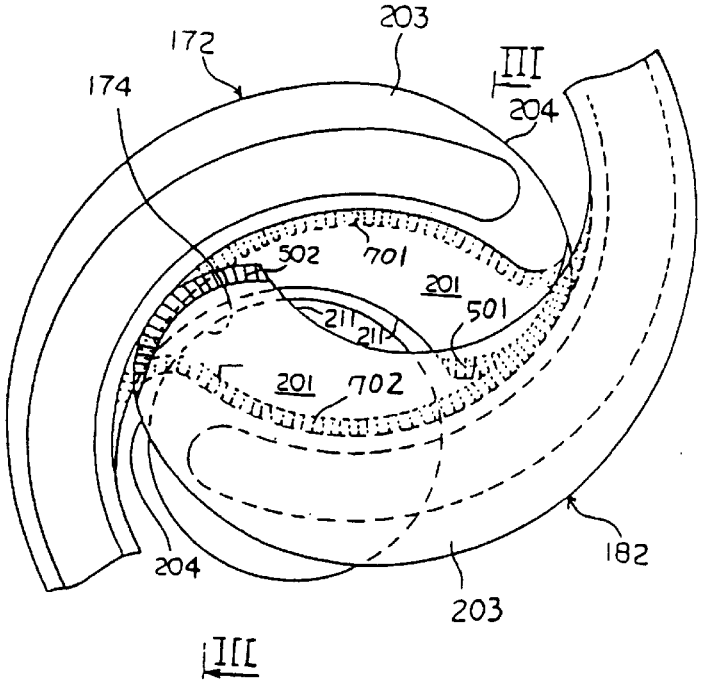
FIG. 10 is an enlarged schematic view illustrating the relative movement of the interfitting spiral elements of the scroll member of the scroll-type refrigerant compressor in accordance with the third embodiment of the present invention.
Figure 11:
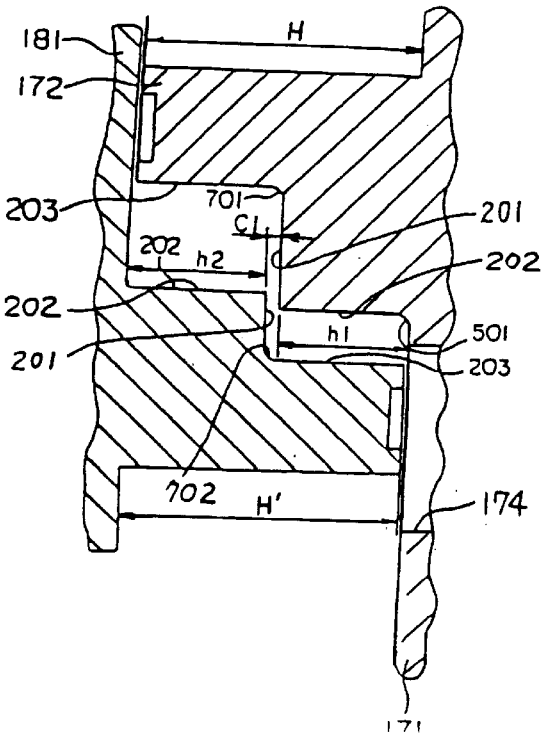
FIG. 11 is an enlarged cross-sectional view of the interfitting spiral elements taken along line XI—XI of FIG. 10.

FIGS. 9, 10 and 11 illustrate a third embodiment of the present invention, which is directed to a modified configuration of spiral wraps 172 and 182 of scroll members 17 and 18. These spiral wraps are similar to spiral wraps 172 and 182 described above. However, some differences do exist.

The radial thickness of the inner end portion of the spiral wraps is increased to strengthen the spiral wraps. However, radius $R_2$ of second curve 208*b* has to be decreased to strengthen the spiral wraps. The end mill cutter applied must have a radius equal to or smaller than radius $R_2$ of the second curve 208*b*.

A recessed portion 211 is formed along root 202 of spiral wrap 172 to facilitate the milling operation. Recessed portion 211 forms the second curve of root 202 (second curve 208*b* is shown by phantom lines for comparison). An arbitrary point $O_5$ is set on the tangent line D-Q, and recessed portion 211 (D-I) of radius $R_5$ is about point $O_5$ as shown in FIG. 9.

Figure 12:
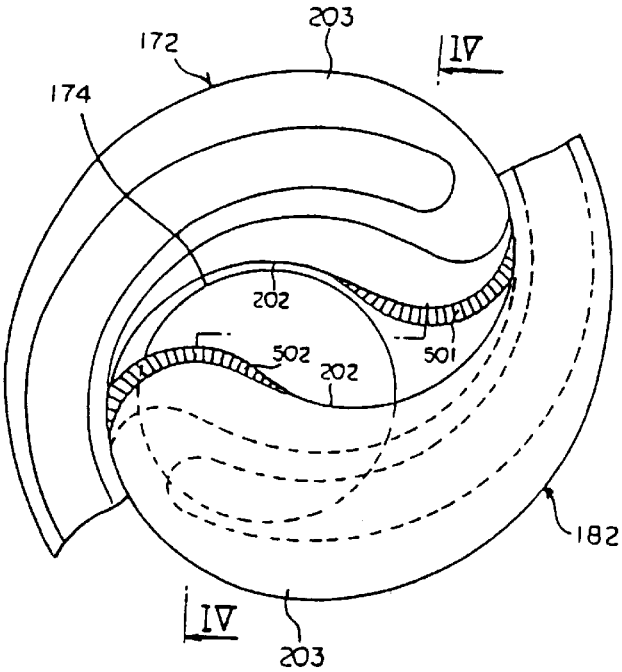
FIG. 12 is an enlarged schematic view illustrating the relative movement of the interfitting spiral elements of the scroll member of the scroll-type refrigerant compressor in accordance with a fourth embodiment of the present invention.
Figure 13:
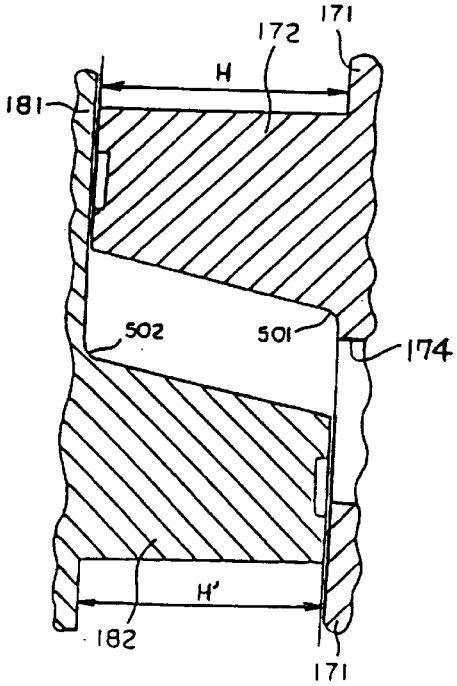
FIG. 13 is an enlarged cross-sectional view of the interfitting spiral elements taken along line XIII—XIII of FIG. 12.

FIGS. 12 and 13 illustrate a fourth embodiment of the present invention which depicts a modified configuration of spiral wraps 172 and 182 of scroll member 17 and 18. These spiral wraps are similar to spiral wraps 172 and 182 described above. However, some differences do exist.

Each cross-sectional area of spiral wraps 172 and 182 is gradually reduced from end plates 171 and 181 to the upper surface of spiral wraps 172 and 182, forming a taper. Further, fillets 501 and 502 are formed at the place at which end plates 171 and 181 join the root or proximal portion 202 of spiral wraps 172 and 182, respectively, similar to FIGS. 5 and 6.

Substantially, similar advantages are related in all the embodiments, so details of the advantages are not repeated.

Although the present invention has been described in connection with preferred embodiments, the invention is not limited thereto. It will be readily understood by those of ordinary skill in the art that variations and modifications may be made within the scope of this invention as defined by the appended claims.

What is claimed is:

1. A scroll-type fluid displacement apparatus comprising:

a housing having a fluid inlet port and a fluid outlet port;

fixed and orbiting scroll members each having an end plate and a spiral element extending from one side of said end plate, said spiral elements interfitting at an angular and radial offset to make a plurality of line contacts defining at least one pair of sealed off fluid pockets;

a driving mechanism including a drive shaft rotatably supported by said housing to effect the orbital motion of said orbiting scroll member by the rotation of said drive shaft to thereby change the volume of said fluid pockets, comprising:

an inner terminal end of said spiral element of each said scroll member including an axial cross-sectional area that changes step-wise from a distal portion thereof to a proximal portion thereof.

2. The scroll-type fluid displacement apparatus recited in claim 1, wherein said inner terminal end of said spiral element of each said scroll member includes an outer side wall formed by an involute curve starting from an arbitrary involute angle and an inner side wall formed by an involute curve starting from an arbitrary involute angle which is 180 degrees greater than said arbitrary involute angle, and at least one curved wall interconnected to said outer side wall to said inner side wall.

3. The scroll-type fluid displacement apparatus recited in claim 1, further comprising an extension at said proximal portion.

4. The scroll-type fluid displacement apparatus recited in claim 3, wherein said extension is a fillet.

5. A scroll-type fluid displacement apparatus comprising:

a housing having a fluid inlet port and a fluid outlet port;

fixed and orbiting scroll members each having an end plate and a spiral element extending from one side of said end plate, said spiral elements interfitting at an angular and radial offset to make a plurality of line contacts defining at least one pair of sealed off fluid pockets;

a driving mechanism including a drive shaft rotatably supported by said housing to effect the orbital motion of said orbiting scroll member by the rotation of said drive shaft to thereby change the volume of said fluid pockets, comprising:

an inner terminal end of said spiral element of each said scroll member including an axial cross-sectional area that changes from a distal portion thereof to a proximal portion thereof and including an extension at said proximal portion, wherein said inner terminal end of said spiral element of each said scroll member includes an outer side wall formed by an involute curve starting from an arbitrary involute angle and an inner side wall formed by an involute curve starting from an arbitrary involute angle which is 180 degrees greater than said arbitrary involute angle, and at least one curved wall interconnected to said outer side wall to said inner side wall, wherein said inner side wall further comprises a first wall, a second wall radially offset from said first wall, and at least one step-like portion joining said first wall to said second wall.

6. The scroll-type fluid displacement apparatus recited in claim 5, wherein an extension is formed between said second wall and said step-like portion.

7. The scroll-type fluid displacement apparatus recited in claim 5, wherein each of said first and second walls of said inner side wall comprises a first arc having a radius and a second arc having a radius greater than that of said first arc.

8. The scroll-type fluid displacement apparatus recited in claim 7, wherein each of said first and second walls further comprise a linear line joining said first arc with said second arc, respectively.

9. The scroll-type fluid displacement apparatus recited in claim 8, wherein said linear lines of said first and second walls are parallel to each other.

10. A scroll-type fluid displacement apparatus comprising:

a housing having a fluid inlet port and a fluid outlet port;

fixed and orbiting scroll members each having an end plate and a spiral element extending from one side of said end plate, said spiral elements interfitting at an angular and radial offset to make a plurality of line contacts defining at least one pair of sealed off fluid pockets;

a driving mechanism including a drive shaft rotatably supported by said housing to effect the orbital motion of said orbiting scroll member by the rotation of said drive shaft to thereby change the volume of said fluid pockets, comprising:

an inner terminal end of said spiral element of each said scroll member including an axial cross-sectional area that changes from a distal portion thereof to a proximal portion thereof, wherein a step-like portion between said distal portion and said proximal portion generates said change in said axial cross-sectional area.

* * * * *